United States Patent [19]

Tamura et al.

[11] 4,391,891

[45] Jul. 5, 1983

[54] DEVELOPING METHOD USING (ALTERNATING ELECTRIC FIELD AND) A DEVELOPER OF THE FIELD-DEPENDENT TYPE AND AN APPARATUS THEREFOR

[75] Inventors: Yasuyuki Tamura, Kawasaki; Junichiro Kanbe, Tokyo; Shunji Nakamura, Kawasaki; Tsutomu Toyono; Tohru Takahashi, both of Tokyo, all of Japan

[73] Assignee: Canon Kabushiki Kaisha, Tokyo, Japan

[21] Appl. No.: 380,391

[22] Filed: May 20, 1982

Related U.S. Application Data

[63] Continuation of Ser. No. 124,911, Feb. 26, 1980, abandoned.

[30] Foreign Application Priority Data

Mar. 5, 1979 [JP] Japan ..... 54-25322

[51] Int. Cl.[3] ..... G03G 13/09

[52] U.S. Cl. ..... 430/120; 430/122; 118/657; 118/647

[58] Field of Search ..... 430/120, 122; 118/657, 118/647

[56] References Cited

U.S. PATENT DOCUMENTS

| | | | |
|---|---|---|---|
| 3,589,895 | 6/1971 | Ville | 430/122 |
| 3,893,418 | 7/1975 | Liebman et al. | 118/647 |
| 4,076,857 | 2/1978 | Kasper et al. | 430/103 |
| 4,095,980 | 6/1978 | Satomi | 430/122 |
| 4,102,305 | 7/1978 | Schwarz | 118/651 |

*Primary Examiner*—John D. Welsh

*Attorney, Agent, or Firm*—Fitzpatrick, Cella, Harper & Scinto

[57] ABSTRACT

A developing method which comprises causing a layer of field-dependent developer which is supported on a supporting member and whose volume resistivity is $10^{12}$ Ω·cm under an electric field of 30000 V/cm to be proximate to the surface of an image bearing member bearing a latent image thereon, and applying an AC voltage to between the substrate of the latent image bearing member and the developer supporting member to thereby effect development, and an apparatus therefor.

8 Claims, 8 Drawing Figures

DEVELOPING METHOD USING (ALTERNATING ELECTRIC FIELD AND) A DEVELOPER OF THE FIELD-DEPENDENT TYPE AND AN APPARATUS THEREFOR

This is a continuation of application Ser. No. 124,911, filed Feb. 26, 1980, now abandoned.

BACKGROUND OF THE INVENTION

1. Field of the Invention

This invention relates to a method of developing a latent image, and more particularly to a developing method which does not create density irregularity in a visualized image and which provides a sharp image free of stain in the non-image area thereof.

2. Description of the Prior Art

In the electrophotographic method or the electrostatic printing method or the like, the magnet brush developing method, the cascade developing method, the fur brush developing method or the powder cloud developing method is known as a method for developing an electrostatic image formed on an image bearing member such as photosensitive medium or master paper and particularly the former two methods have been widely used in practical apparatuses.

Any of these developing methods has comprised bringing developer into contact with the entire surface of the image bearing member, namely, indiscriminately bringing developer into contact with both of the image area on the image bearing member which has an electrostatic charge image and the non-image area on the image bearing member which has no electrostatic charge image, and could be called the indiscriminate contact system. In such indiscriminate contact system, adherence of the developer to the non-image area of the image bearing member has unavoidably occurred to create stain (so-called fog) in the background portion of the developed image which has diminished the dignity of the visualized image.

The developer used in this development is generally classified into a two-component developer consisting of a mixture of carrier such as powdered iron or glass beads and toner and a one-component developer containing no carrier.

In the case of the two-component developer, it is difficult to maintain the mixture ratio always constant and density of the developed image is varied by a variation in this mixture ratio. Also, deterioration of the carrier is unavoidable and this also affects the developing density. Accordingly, in the case of the two-component developer, it has been difficult to maintain the uniformity of the density. Fog could be somewhat but not completely alleviated by application of a bias to the developing device.

In the case of the one-component developer, it has been possible to maintain the density of the developed image constant, but the fog as mentioned above has generally been unavoidable. Particularly, magnetic developer typical as the one-component developer has been used for development by the magnet brush developing method. However, in such development, fog has occurred probably due to the frictional contact of the magnet brush and a sharp image has been difficult to obtain. That is, the magnet brush is usually formed on a sleeve roller having a magnet roller or a magnet disposed therewithin and is used for development by rotation of that roller and therefore, the ensuing magnet brush further frictional contacts the once developed image area to disturb the developer adhering to the marginal portion of the image. By this, the marginal portion of the image has been disturbed and the sharpness of the image has been lost.

On the other hand, as a method which causes no fog in the visualized image, there is known the developing method disclosed in U.S. Pat. No. 3,232,190. This comprises causing a supporting member supporting insulative developer particles thereon to be opposed to an image bearing member bearing an electorstatic image thereon with a clearance of several millimeters maintained therebetween, maintaining the developer so as not to contact the non-image area while, on the other hand, causing the developer particles to fly to the image area to thereby effect development, and is called the toner transfer development.

According to this toner transfer development, only the image area is selectively developed without bringing the developer into contact with the non-image area of the image bearing member and such method can be called the selective imparting developing system in contrast with the indiscriminate contact system which is common to the aforementioned developing methods.

As such system, there have also been proposed methods different from the developing method disclosed in the afore-mentioned U.S. Pat. No. 3,232,190. They are, for example, the methods disclosed in U.S. Patent Applications Ser. Nos. 938,101; 938,494; 58,434 and 58,435 proposed by the assignee of the present invention. These Applications disclose the methods which eliminate fog and which comprises opposing a developer supporting member to a latent image bearing member with a very minute clearance therebetween, forming on the supporting member a one-component developer layer thinner than the minute clearance, and causing the developer to be transferred by utilizing an electrostatic attraction created only in the image area of the latent image surface.

SUMMARY OF THE INVENTION

It is an object of the present invention to provide a developing method which utilizes the so-called selective imparting developing system adopted to eliminate fog and uses a developer specific to this system and causes the merits of such system to be exhibited to the utmost by applying an AC bias, and an apparatus therefor.

It is another object of the present invention to provide a developing method which uses a layer of developer whose volume resistivity is $10^{12}\Omega\cdot$cm or less under an electric field of 3000 V/cm and applies an AC bias voltage to effect development, and an apparatus therefor.

It is still another object of the present invention to provide a developing method which satisfies $\int \propto E^x$, $x < -0.5$, where $\int$ is the volume resistivity of the developer, E is the intensity of the electric field and x is the index, and an apparatus therefor.

It is yet still another object of the present invention to provide a developing method which uses a developer whose volume resistivity is $10^7\Omega\cdot$cm or higher for the intensity of the electric field of 500 V/cm.

The specific one-component developer (hereinafter also referred to as one-component toner) used in the developing method of the present invention must have sufficient electrical conductivity for introduction of charges to occur from a sleeve which is a toner carrier when the developer has become opposed to the electrostatic image. According to the experiment carried out by the inventors, it has been confirmed that if the one-component developer has a volume resistivity of $10^{12}\Omega\cdot$cm or less, sufficient charges to effect development can be introduced.

The developing method of the present invention is characterized in that a developer layer which is supported on a supporting member and whose volume resistivity is $10^{12}\Omega\cdot$cm or less under an electric field of 3000 V/cm is brought into proximity to the surface of an image bearing member bearing a latent image thereon and an AC voltage is applied to between the substrate of the electrostatic image bearing member and the developer supporting member to effect development.

The above and other objects, features and construction of the present invention will become apparent to those skilled in the art by understanding embodiments of the invention which will hereinafter be described in conjunction with the accompanying drawings.

DESCRIPTION OF THE PREFERRED EMBODIMENTS

Figure 1:
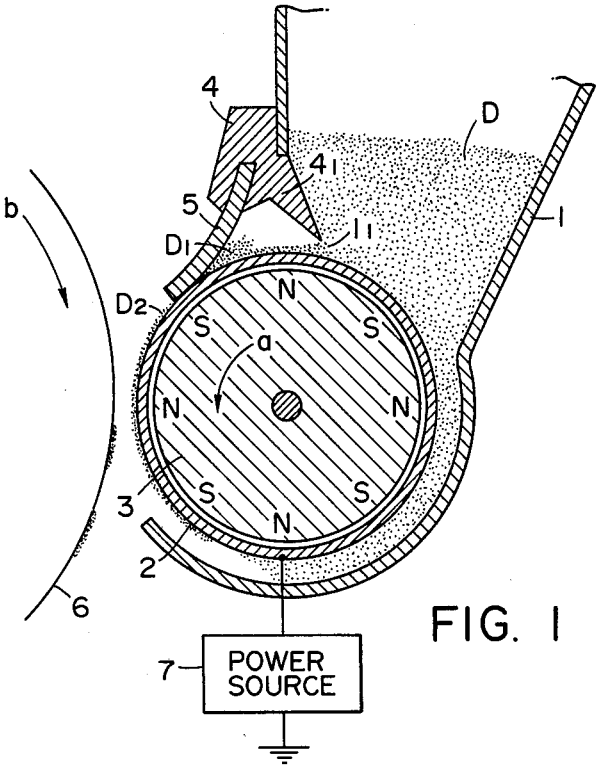
FIG. 1 is a cross-sectional view of an embodiment of the developing device according to the present invention.

FIG. 1 illustrates a first embodiment of the apparatus for carrying out the developing method according to the present invention.

The shown example of the developing apparatus comprises a developer container 1 for containing therein developer D whose volume resistivity is dependent on an electric field, a non-magnetic cylindrical sleeve 2 of aluminum or non-magnetic stainless metal supported for rotation in the lower portion of the developer container with a part of the sleeve being projected from an opening $1_1$ provided in the side wall of the container, and a magnetic roller 3 fixedly disposed in the sleeve. A holder 4 fixed to the side wall of the container above the opening through which the sleeve is projected holds a developer layer thickness controlling plate 5 formed of a rubber sheet or the like and resiliently urged against the surface of the sleeve. Of course, this controlling plate may be a magnetic material. The holder 4 extends from the upper end of the opening toward the surface of the sleeve so as to prevent excessive outflow of the developer from the opening, and a projected portion $4_1$ narrowing the clearance extends over the full width of the opening. That part of the developer D in the developer container 1 which has passed through the clearance formed by the projected portion $4_1$ of the holder forms a developer layer $D_1$ on the surface of the sleeve 2.

The sleeve 2 is rotated in the direction of arrow a by a conventional drive source, not shown, and tries to pass the position of the aforementioned developer layer thickness controlling plate 5. At this time, the developer layer thickness controlling plate 5 tries to block the passage of the developer, but that plate has a resilient force like that of a rubber sheet and therefore, in accordance with the resilient pressure contact force thereof and the passage speed, the developer layer $D_1$ is controlled to a layer thickness $D_2$ optimal for development, usually of the order of 30–100$\mu$, and goes toward a portion to be developed. The portion to be developed is an image bearing member 6 comprising a photosensitive medium or an electrostatic printing master provided in the form of a drum, and is disposed in proximity to the sleeve supporting the thickness-controlled developer layer $D_2$ and is rotated in the direction of arrow b. Development is effected near the portion at which the spacing between the two is narrowest, thereby forming a visualized image on the image bearing member 6.

The clearance between the image bearing member and the sleeve is maintained within a range from about 1/5 of the developer layer thickness on the sleeve to less than then times of such developer layer thickness in the developer surface on the sleeve and the non-image area of the image bearing member. Accordingly, where the developer layer on the sleeve is controlled to about 100$\mu$, it is preferable to set the clearance between the sleeve surface and the image bearing member to 120$\mu$ to 1100$\mu$. By so controlling the developer layer thickness and so setting the clearance between the image bearing member and the developer layer, it is possible to well achieve the development previously proposed by the assignee of the present invention (U.S. Patent Applications Ser. Nos. 938,101; 938,494; 58,434 and 58,435). The principle thereof will later be described in detail. In the development proposed in these applications, the developer is transferred toward the image area for development by the electrical attraction of the image area. Incidentally, the image bearing member and the sleeve have curvatures corresponding to their radii, respectively, and the sleeve supporting the developer on the surface thereof approaches the image bearing member as it is rotated from the position of the controlling plate 5 toward the developing position. The developer $D_2$ on the sleeve surface preferably enters into an electric field acting area based on the electrostatic charge of the image bearing member surface and as it approaches such area, the intensity of the electric field increases and so, the force for causing the developer particles to be moved becomes greater. However, the developer on the sleeve of which the volume resistivity depends on the intensity of the electric field has the movement thereof substantially blocked until it reaches the aforementioned clearance area. Incidentally, where the electrostatic image potential on the image bearing member is 500 V, the intensity of the electric field at a point in the vicinity of 1000$\mu$ is 5000 V/cm, but before that area is reached, for example, at a point of 2 cm (2000$\mu$), the intensity of the electric field is 250 V/cm. This is the case where no AC bias is applied, but in the case of the embodiment of the present invention in which the AC bias described in U.S. Patent Application Ser. No. 58,435 is imparted from a power source 7 to the developing clearance, the electric field E formed by the AC voltage becomes smaller as the distance between the sleeve and the image bearing member is greater, and becomes greater as said distance is smaller.

If the potential of the electrostatic image is $V_s$ and the bias voltage is $V_B = V_o \sin \omega t$ and the distance is d, then the electric field E is expressed as follows:

$$E = \frac{V_s - V_B}{d} = \frac{1}{d}(V_s - V_o \sin \omega t) \quad (1)$$

If $V_o = 500$ V and $V_s = 500$ V, the maximum value of the electric field becomes E=500 V/cm for d=2 cm and E=10000 V/cm for d=1000μ, in accordance with a variation in distance.

In the method of this embodiment, the developer has its volume resistivity varied depending on the intensity of the electric field and an AC bias voltage is applied to the developer carrying member and so, that variation is such that the volume resistivity tends to be reduced by an increase in the intensity of the electric field. If the volume resistivity of the developer has a tendency of being proportional to −0.5 power or less of the intensity of the electric field in the range of at least 500 V/cm to 30000 V/cm, there will be obtained a good result. Further, if the volume resistivity of the developer is proportional to −1 power of the intensity of the electric field, there will be obtained a better result.

In other words, when the volume resistivity of the developer is ∫ and the intensity of the electric field is E and the index is x, if $$\int \propto E^x,\ x \leqq -0.5 \quad (2),$$

there will be obtained a good result, and further, if $$\int \propto E^x,\ x < -1 \quad (3),$$

there will obtained a better result.

As will later be described in detail, a certain developer in the embodiment exhibits a volume resistivity of $10^7 \Omega \cdot$cm or higher under a weak electric field of 500 V/cm or less, and exhibits a volume resistivity of the order of $10^6 \Omega \cdot$cm under a strong electric field of the order of 30,000 V/cm and accordingly, when the distance between the sleeve and the image bearing member becomes closer and an area substantially good for development is reached, a strong electric field of about 30,000 V/cm acts on the developer on the sleeve to reduce the volume resistivity thereof and thus, the movement of the developer for development is well accomplished.

That is, under a weak electric field, the volume resistivity of the developer is high and it is difficult for a charge to be induced in the developer and in this state, the movement of the developer is suppressed. When the developer moves to an area of weak electric field with the movement of the developer supporting member, the volume resistivity of the developer is reduced to permit a sufficient charge to be induced in the developer particles in a short time. When such a state is reached, movement of the developer becomes possible. Under such a state, an AC bias as described previously is applied to the clearance between the developer layer and the image bearing member, so that the developer in this state is subjected to an electric field which causes the developer to move from the developer supporting member to the latent image bearing member and from the latent image bearing member to the developer supporting member and coupled with this action, good development can be accomplished. That is, as described in U.S. patent applications Ser. Nos. 58,434 and 58,435, by applying an AC electric field preferably having a frequency of 1 KHz or less to the developing clearance, transfer of the developer (including the flying development of the developer and the extension development of the developer) from the developer supporting member not only to the image area but also to the non-image area of the latent image bearing member is caused in the phase wherein said AC bias potential is added to the image area potential of the latent image, and in the opposite phase of the next AC bias, an electric field by which the developer is brought from the latent image bearing member back to the developer supporting member is applied and therefore, by the rising of such reciprocating movement of the developer, there are attained the effects that (i) tone reproducibility is very good, (ii) fog can all be neglected and (iii) the fidelity of the visualized line image is very high.

Further, in the magnet brush development using electrically conductive toner (toner whose resistance is variable by an electric field is also an example of the electrically conductive toner), neutralization of charge occurs between the charge of the toner which has once adhered to the image area and the charge forming the electrostatic image and such toner loses its adhesive force and therefore, there is a disadvantage that such toner is cleared away by the brush. This makes difficult the development using electrically conductive toner, and this phenomenon is particularly remarkable in a smooth-surfaced electrostatic image bearing member (for example, Se, resin insulating layer, organic semiconductor, or the like).

However, in the above-described AC bias development, no brush contacts the electrostatic image bearing member and there is no fear that the toner is cleared away.

In the AC bias development, the main force which draws apart the toner which has once adhered to the electrostatic image bearing member is an AC electric field. That is, the toner which has adhered in one half cycle of the AC electric field is subjected to the reverse force in the next half cycle and drawn apart (some of the toner which has adhered to the high potential area may not be drawn apart).

In this case, even if neutralization of charge occurs between the charge of the toner which has adhered to the image area and the charge of the electrostatic image, the toner which has adhered to the image area is not drawn apart. This is because that toner has lost the charge due to the neutralization of charge and therefore it is not subjected to the force of the electric field. Thus, even a smooth-surfaced electrostatic image bearing member as mentioned above can be easily and stably developed.

In the non-image area, the charge of the toner which has adhered thereto is not neutralized and therefore such toner can be readily drawn apart in the next half cycle of the AC electric field.

In this non-image area, when the spacing between the electrostatic image bearing member and the toner supporting member is narrow, the toner effects reciprocating movement in accordance with the positive and negative cycles of the alternating current, but even if the spacing gradually becomes wider to weaken the electric field, the charge once introduced into the toner is not lost and it is therefore inferred that the toner continues its reciprocating movement until the spacing becomes considerably wider, but as the spacing becomes wider, the force provided by the AC electric field becomes weaker and the reciprocating movement of the toner ceases.

Accordingly, the AC bias does not so much affect the developer and the intensity of the electric field which affects the developer on the sleeve is weak and therefore, development is terminated without occurrence of movement of excessive developer particles.

Figure 2A:
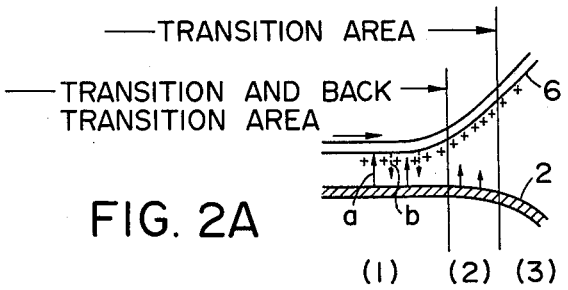
FIGS. 2A and 2B illustrate the principle of the present invention.
Figure 2B:
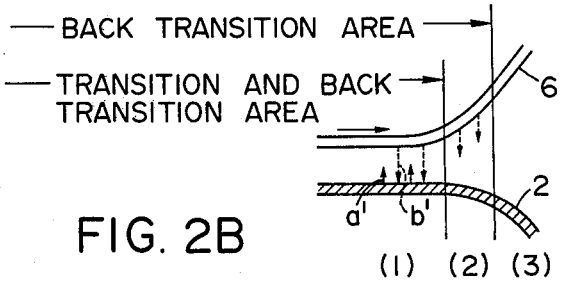
Figure 2C:
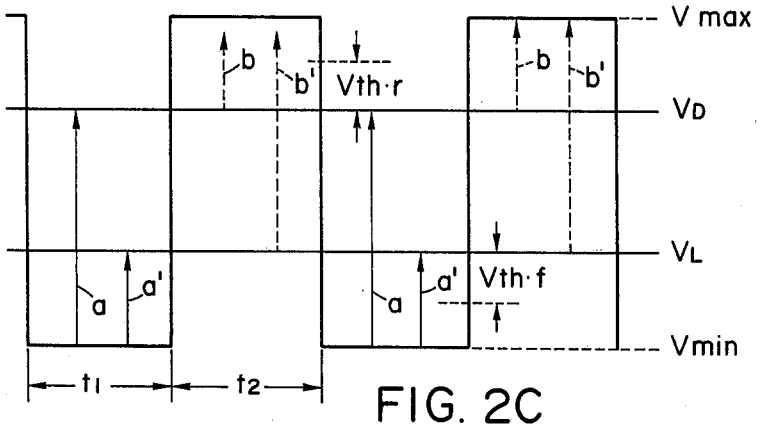
FIG. 2C is a schematic showing an example of the waveform of the AC bias applied therein.

An example of such developing process with an AC bias according to the above description is shown in FIGS. 2A and 2B. As shown in FIGS. 2A and 2B, the electrostatic image bearing member 6 is moved in the direction of arrow through developing regions (1) and (2) to a region (3). Designated by 2 is a toner carrier. Thus, the electrostatic image bearing surface and the toner carrier gradually widen the clearance therebetween from their most proximate position in the developing station. FIG. 2A shows the image area of the electrostatic image bearing member and FIG. 2B shows the non-image area thereof. The direction of arrows shows the direction of the electric fields and the length of the arrows indicates the intensity of the electric fields. It is important that the electric fields for the transition and back transition of the toner from the toner carrier are present also in the non-image area. FIG. 2C shows a rectangular wave which is an example of the waveform of the alternate current applied to the toner carrier, and schematically depicts, by arrows in the rectangular wave, the relation between the direction and intensity of the toner transition and back transition fields. The shown example refers to the case where the electrostatic image charge is positive, whereas the invention is not restricted to such case. When the electrostatic image charge is positive, the relations between the image area potential $V_D$, the non-image area potential $V_L$ and the applied voltages $V_{max}$ and $V_{min}$ are set as follows:

$$\left.\begin{aligned} |V_{max} - V_L| &> |V_L - V_{min}| \\ |V_{max} - V_D| &< |V_D - V_{min}| \end{aligned}\right\} \quad (3)$$

In FIGS. 2A and 2B, a first process in the development occurs in the region (1) and a second process occurs in the region (2). In the case of the image area shown in FIG. 2A, in the region (1), both of the toner transition field a and the toner back transition field b are alternately applied correspondingly to the phase of the alternate field and the transition and back transition of the toner result therefrom. As the developing clearance becomes greater, the transition and back transition fields become weaker and the toner transition is possible in the region (2) while the back transition field sufficient to cause the back transition (below the threshold value $|Vth \cdot \gamma|$) becomes null. In the region (3), the transition neither takes place any longer and the development is finished.

In the case of the non-image area shown in FIG. 2B, in the region (1), both the toner transition field a′ and the toner back transition field b′ are alternately applied to create the transition and back transition of the toner. Thus, fog or toner deposition to the background is created in this region (1). As the clearance is wider, the transition and the back transition field become weaker and when the region (2) is entered, the toner back transition is possible while the transition field sufficient to cause transition (below the threshold value) becomes null. Thus, in this region, fog is not substantially created and the fog created in the region (1) is also sufficiently removed in this stage. In the region (3), the back transition neither takes place any longer and the development is finished. As regards the half-tone image area, the amount of toner transition to the final latent image surface is determined by the magnitudes of the amount of toner transition and the amount of toner back transition corresponding to that potential, and after all, there is provided a visible image having a good tone gradation.

In this manner the toner is caused to fly over the developing clearance and is caused to temporally reach the non-image area as well as to improve the tone gradation, and in order that the toner having reached the non-image area may be chiefly stripped off toward the toner carrier, it is necessary to properly select the amplitude and alternating frequency of the alternate bias voltage applied. Results of the experiment in which the effect of the present invention has clearly appeared by such selection will be shown in the following embodiment.

Figure 3:
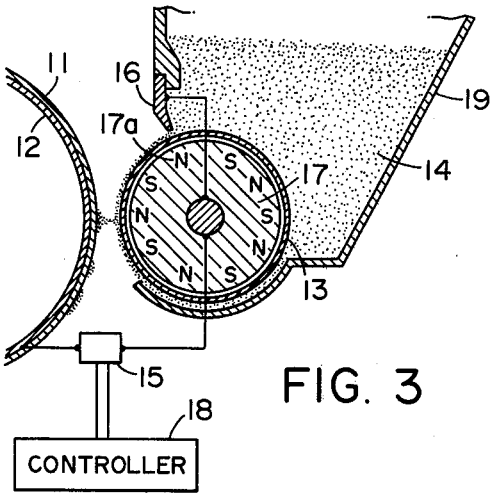
FIG. 3 is a cross-sectional view showing another embodiment of the developing device according to the present invention.

FIG. 3 shows another embodiment which uses the toner of the field-dependent type described in connection with FIG. 1 and in which the AC bias as described above is introduced into the developing region.

Figure 4A:
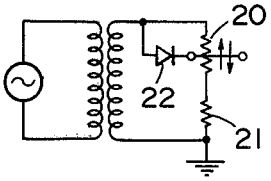
FIG. 4A is a diagram of a distorted sine wave generating circuit.

In FIG. 3, reference numeral 11 designates an electrostatic latent image bearing member having an insulating layer on a CdS layer, and 12 a back electrode thereof. The members 11 and 12 form a drum shape. Designated by 13 is a non-magnetic stainless metal sleeve having a magnet roll 17 therewithin. The electrostatic latent image bearing member 11 and the sleeve 13 are held with the minimum clearance therebetween maintained at about 300μ by a well-known clearance maintaining means. Designated by 14 is a one-component magnetic developer in a developing container 19. Designated by 16 is an iron blade opposed to the main pole 17*a* (850 gausses) of the magnet roll 17 enclosed in the sleeve 13. The iron blade controls the thickness of the magnetic developer 14 applied onto the sleeve 13 by a magnetic force. The clearance between the blade 16 and the sleeve 13 is maintained at about 240μ and the thickness of the developer layer applied onto the sleeve 13 by the blade 16 is about 100μ. Designated by 15 is a variable alternate voltage source controlled by a controller 18 (the details of which are shown in FIG. 4A) and the voltage therefrom is applied to between the back electrode 12 and the conductive portion of the sleeve 13. The blade 16 and the sleeve 13 are at the same potential to prevent irregularity of application of the developer.

The average value of the electrostatic image potential is +500 V for the image area and OV for the non-image area. The extraneous alternate voltage comprises a sine wave of frequency 400 Hz and peak-to-peak 1000 V rendered into a distorted sine wave having an amplitude ratio of about 1.9:1 between the positive phase and the negative phase. Again by this embodiment, it was possible to obtain visible images of good quality which were excellent in tone gradation and which were clear and free of fog.

Figure 4B:
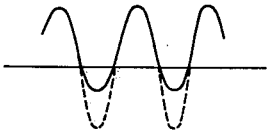
FIG. 4B shows the waveform thereof.

An example of the circuit for providing such a distorted sine wave is shown in FIG. 4A. FIG. 4B illustrates the distorted output wave of such circuit.

The circuit of FIG. 4A produces the distorted sine wave as shown in FIG. 4B by reducing only the negative (−) side of the sine wave alternating voltage by means of a diode 22 and resistors 20, 21, and if the resistor 20 of the output terminal O is caused to slide, the negative (−) side voltage may be made variable. This circuit construction enables the circuit to be formed more easily than the DC superimposed type.

Figure 5:
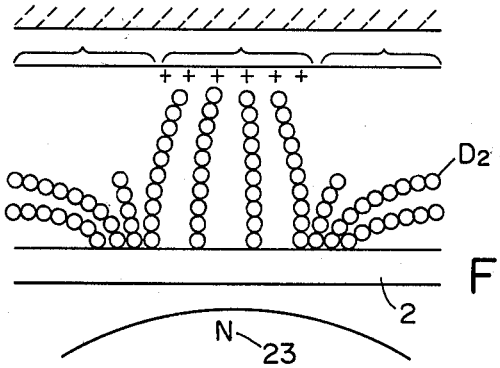
FIG. 5 is a schematic illustrating the behavior of magnetic developer.

In the above-described embodiments, if a developing magnetic pole is disposed at the developing position, the operation and effect will particularly be increased. For example, if a magnetic pole (N pole) is disposed on the developer carrier side as shown in FIG. 5 and a magnetic developer having said characteristic is used, the erection of the developer particles will be better accomplished because the magnetic field action is imparted in addition to the action of the AC bias. By this erection being accomplished well, the ends of the erected developer particles are reliably directed to the electrostatic image area to remarkably eliminate the undesirable possibility that the developer adheres to around the image area to create blurred image.

Also, during the erection of the developer particles, if there is a magnetic field, a restraining force acts toward the supporting member, so that the contact pressure between the developer particles is enhanced to enable charge to be effectively induced in each developer particle when the electrical conductivity is reduced under a strong electric field.

On the other hand, even when the electrostatic image formed on the image bearing member has some potential in the background thereof, the method of the present invention can provide a good developed image which is free of fog.

That is, even when the electrostatic image has some surface potential in the background thereof, the intensity of the electric field based on that surface potential is low and accordingly, the variation in volume resistivity of the developer particles lying at a corresponding position is very small as compared with that of the developer lying at the position corresponding to the electrostatic image and therefore, there is no fear that the developer particles corresponding to the background portion are moved.

Accordingly, there is no fear that the developer particles adhere to the non-image area, thus enabling fogless good development to be accomplished.

Such field-dependent developer whose volume resistivity is varied in accordance with the variation in intensity of the electric field can be produced as by mixing an electrically conductive material such as carbon with insulative resin and powdering the mixture.

In the case of electrically conductive toner, when an AC bias is applied, it is preferable that no DC bias is superimposed thereon. If a DC bias is superimposed at all, it is advisable to apply a DC voltage substantially equal to the potential of the non-image area in order to prevent creation of fog when the non-image area is at a positive or a negative potential.

To make the present invention more readily understood, some examples thereof using specific developers will hereinafter be described.

EXAMPLE 1

Of the composition shown in Table 1 below, magnetite and epoxy resin were first mixed together and powdered, whereafter hydrophobe colloidal silica and carbon were added to the mixture and the mixture of the four materials was stirred at a temperature of 30° to 40° C. to obtain a developer. This developer was supplied to the surface of the sleeve constructed as shown in FIG. 1 or 3, and controlled by the developer layer thickness controlling plate to form a developer layer of about 100μ. On the other hand, an electrostatic charge image having a surface potential of about 300 V to 500 V was formed on the image bearing member and the electrostatic image was developed with a clearance of 100 to 200μ maintained between the image bearing member and the developer layer surface and by applying $V_{pp}$ 1000 V, 250 to 400 Hz as an AC bias to the sleeve. By this development, there was obtained a good developed image having no fog in the non-image area thereof and having no blur in the image end portions.

TABLE 1

| | |
|---|---|
| Magnetite | 60% by weight |
| Epoxy resin | 38.7% by weight |
| Carbon | 1.2% by weight |
| Hydrophobe colloidal silica | 0.1% by weight |

The volume resistivity of said developer was $2\times10^7\Omega\cdot$cm under an electric field of 500 V/cm, and $1.3\times10^6\Omega\cdot$cm under an electric field of 30,000 V/cm. When the surface potential of the image bearing member in this Example is 500 V, the intensity of the electric field of 500 V/cm in about 2 cm from the image bearing member surface, and the intensity of the electric field of 30,000 V/cm is about 330μ.

The measurement of the volume resistivity of said developer was carried out by using an aluminum electrode, maintaining a clearance of about 0.3 mm by means of a spacer of Teflon and filling the space surrounded by the spacer and the electrode surface of about 40×40 mm with the developer to be measured.

EXAMPLE 2

Developer of the composition shown in Table 2 below was produced by first mixing $\gamma$-$Fe_2O_3$, polyethylene and polyester resin, powdering the mixture, thereafter adding hydrophobe colloidal silica and carbon to the mixture and stirring the mixture of the five materials at a temperature of several tens of degrees.

TABLE 2

| | |
|---|---|
| $\gamma$-$Fe_2O_3$ | 64% by weight |
| Polyethylene | 30% by weight |
| Polyester resin | 3% by weight |
| Carbon | 1.5% by weight |
| Hydrophobe colloidal silica | 1.5% by weight |

When this developer was used in a developing device in the same manner as Example 1 to develop an image bearing member, there was obtained a good visible image which was free of fog and free of blur in the image end portions. The volume resistivity of this developer is $1.3\times10^{14}\Omega\cdot$cm for 300 V/cm, $1.2\times10^{11}\Omega\cdot$cm for 300 V/cm and $2.5\times10^8\Omega\cdot$cm for 10,000 V/cm.

Of course, the present invention is not restricted to the above-shown Examples and embodiments.

The present invention, as described above, uses a one-component developer having a specific field-dependency and applies an AC bias to the developing clearance to cause movement of the developer to take place relatively strongly only in the clearance which is directly concerned with development as described and therefore, as previously described, there is an effect that faithful development can be accomplished which is free of fog and excellent in tone gradation and which causes no thinning of lines.

When the clearance between the image bearing member and the developer is not suitable, no movement of the developer is caused to take place and development is not effected until a suitable clearance is obtained and therefore, adherence of unnecessary developer to the marginal portion of the image does not take place, thus enabling obtainment of a good developed image which is free of blur.

During the development, the developer does not contact the non-image area and thus, a good developed image free of fog is obtained. Moreover, even if the non-image area has some background potential, it is difficult for the developer to move in a low electric field and this eliminates the undesirable possibility of creating fog.

We claim:

1. A developing method for developing the latent image on a latent image bearing member, comprising:

forming a layer of one-component developer on a developer supporting member, wherein said layer has a thickness which is less than a clearance, at a developing station, between the image bearing member and the supporting member, and wherein said developer is selected as having a volume resistivity which varies with variations in an electric field to which it is subjected;

conveying said layer of one-component developer to the developing station;

applying an alternating electric field between said developer layer supporting member and said latent image bearing member at the developing station, whereby said alternating electric field causes transition of said developer from said developer supporting member to both the image and non-image areas of said latent image bearing member and back transition of said developer from said latent image bearing member to said supporting member; and reducing the intensity of said alternating electric field to thereby cause said back transition at least in the non-image areas and leave a developed image on said latent image bearing member.

2. The developing method according to claim 1, wherein said developer has a volume resistivity of $10^{12}\Omega\cdot$cm or less under an electric field of 3000 V/cm.

3. The developing method according to claim 1, wherein said developer satisfies $$\begin{cases} \int \propto E^x \\ x < -0.5 \end{cases}$$

where $\int$ is the volume resistivity of the developer, E is the intensity of the electric field and x is the index.

4. The developing method according to claim 1, wherein said one-component developer comprises a magnetic material, said developer supporting member comprises a hollow drum, and said step of conveying the developer to a developing station is performed by means of a drum-shaped magnet disposed within said hollow developer drum.

5. The developing method according to claim 1, wherein the volume resistivity of said developer is $10^7\Omega\cdot$cm or higher for an electric field intensity of 500 V/cm or less.

6. The developing method according to claim 1, wherein the frequency of said alternating voltage is 1 KHz or less.

7. A developing method for developing a latent image formed on an image bearing member, comprising:

forming a layer of one-component magnetic developer on a developer supporting sleeve, wherein said layer has a thickness which is less than a clearance, at a developing station, between the image bearing member and the supporting sleeve, and wherein said developer is selected as having a volume resistivity which varies with variations in an electric field to which it is subjected;

conveying said layer of one-component magnetic developer to the developing station by a relative rotation between said sleeve and a magnet enclosed in said sleeve;

applying an alternating electric field between said developer layer supporting sleeve and said latent image bearing member at the developing station, whereby said alternating electric field causes transition of said developer from said developer supporting sleeve to both the image and non-image areas of said image bearing member and back transition of said developer from said image bearing member to said supporting sleeve; and reducing the intensity of said alternating electric field to thereby cause said back transition at least in the non-image areas and leave a developed image on said image bearing member.

8. A method according to claim 7, wherein said sleeve is rotatable while said magnet is fixed and provides a magnetic field at the developing station.

* * * * *